US011034553B1

(12) United States Patent
Crager et al.

(10) Patent No.: US 11,034,553 B1
(45) Date of Patent: Jun. 15, 2021

(54) POST HANDLING TOOL ADAPTABLE FOR MOUNTING ON A SKID STEER DEVICE

(71) Applicants: Tom W. Crager, Stateline, MS (US); Tyler C. Crager, Stateline, MS (US)

(72) Inventors: Tom W. Crager, Stateline, MS (US); Tyler C. Crager, Stateline, MS (US)

( * ) Notice: Subject to any disclaimer, the term of this patent is extended or adjusted under 35 U.S.C. 154(b) by 0 days.

(21) Appl. No.: 16/676,646

(22) Filed: Nov. 7, 2019

(51) Int. Cl.

| | |
|---|---|
| ***B66C 1/42*** | (2006.01) |
| ***B66C 1/58*** | (2006.01) |
| ***B66F 9/18*** | (2006.01) |
| ***B66C 23/44*** | (2006.01) |

(52) U.S. Cl.
CPC ..... *B66C 1/427* (2013.01); *B66C 1/585* (2013.01); *B66C 23/44* (2013.01); *B66F 9/18* (2013.01)

(58) Field of Classification Search
CPC ..... B66C 1/427; B66F 9/183; B66F 9/184
See application file for complete search history.

(56) References Cited

U.S. PATENT DOCUMENTS 4,067,369 A * 1/1978 Harmon ..... A01G 23/065 144/24.12
4,212,577 A * 7/1980 Swanson ..... B66C 1/427 294/201
6,010,294 A 1/2000 Lyddon
6,592,316 B2 * 7/2003 Hensler ..... E02D 7/26 212/292
7,198,312 B2 4/2007 Blaho
8,544,946 B2 10/2013 Holden
8,561,325 B1 10/2013 Hegener et al.
9,267,307 B2 * 2/2016 St-Yves ..... E04H 12/347
9,470,015 B2 10/2016 Hall
2009/0269181 A1 * 10/2009 Moffitt ..... B66F 9/18 414/732
2015/0042116 A1 2/2015 Jacobson

OTHER PUBLICATIONS

Skid Steer Post Driver Works Like a Jackhammer. Article [online]. © 2019 Farm Show Magazine [2015—vol. 39, Issue #4, p. 16; retrieved on Apr. 24, 2019]. Retrieved from the Internet: <URL: https://www.farmshow.com/a_article.php?aid=29555>.
Skid Steer Drum Clamp, Rotate. Product Listing [online]. © 2013-2018—Valley Craft Industries, Inc [retrieved on Apr. 24, 2019]. Retrieved from the Internet: <URL: https://www.valleycraft.com/component/hikashop/product/3071-f89698-skid-steer-drum-handling-attachment>.
HD Pole Setter. Product Listing [online]. EZ Spot Ur Attachments [retrieved on Apr. 24, 2019]. Retrieved from the Internet: <URL: https://ezspotur.com/prod_hdpole.php>.

* cited by examiner

*Primary Examiner* — Jonathan Snelting
(74) *Attorney, Agent, or Firm* — Cramer Patent & Design, PLLC; Aaron R. Cramer

(57) ABSTRACT

A post handling tool is adaptable for mounting on a skid steer device. It utilizes a pair of hydraulic clamps secured to a base having a vertical stabilizing pole perpendicularly secured to the base.

13 Claims, 5 Drawing Sheets

POST HANDLING TOOL ADAPTABLE FOR MOUNTING ON A SKID STEER DEVICE

RELATED APPLICATIONS

None.

FIELD OF THE INVENTION

The present invention relates to a post handling tool adaptable for mounting on a skid steer device.

BACKGROUND OF THE INVENTION

Tractors are very handy vehicles commonly used around farms, nurseries, and for general landscaping and maintenance. They are also often used in construction along with their close cousins, the skid steer loaders and front-end loaders. Their small size and maneuverability allow them to operate in tight spaces. Their light weight allows them to be towed behind a full-size pickup truck, and the wide array of attachable accessories makes them very flexible. They are commonly used by landscapers to move landscaping and building materials, and a wide variety of other tasks. However, such machines are not very useful when it comes to comes to picking up long linear objects such as logs or pipes and are even less useful when trying to lift such items into a vertical position such as when placing poles into the ground for a pole building or elevated deck. Such maneuvers often require the use of a separate crane along with an increase in construction cost and another machine causing congestion on a construction site. Accordingly, there exists a need for a means by which tractors, skid steer machines and the like can be modified to increase their usefulness when handling and moving long linear loads. The development of the post handling tool adaptable for mounting on a skid steer device fulfills this need.

SUMMARY OF THE INVENTION

The inventor has recognized the aforementioned, inherent problems and lack in the art and observed that there is a need for a post handling attachment, comprising a back plate adapted to a standard skid steer attachment system found on a skid steer machine or a tractor and pair of movable jaw plates provided on a face of the post handling attachment. The pair of movable jaw plates serve as a contact grabbing point for a long linear object being lifted. The movable jaw plates are each provided with a support arm to allow for grabbing movement of the movable jaw plates. There is also a plurality of reinforcing supports provided to reinforce a joint between the movable jaw plates and the support arms and a safety support provided at a center top portion of the back plate to restrain the lifted long linear object from falling backwards. There is also a U-shaped restraint disposed at a top of the safety support to prevent falling behind the sides of the post handling attachment. The safety support is attached to the back plate using a collar and an anchor bolt which allows for ready removal of the safety support during transport of the post handling attachment.

There is also an enclosure housing a hydraulic cylinder that drives an actuating arm back and forth along a first travel path. The actuating arm is connected to the support arms via a pair of driver arms to allow the movable jaw plates to open and close. The hydraulic cylinder is connected to the hydraulic system of the host vehicle via a high-pressure supply hose and a return hose supplied with a quick connect fitting. The safety support along with the "U"-shaped restraint is mechanically attached to the back plate via the collar while a piston of the hydraulic cylinder is connected to the actuating arm via a third pivot point. There is also a plurality of angular protrusions which help to grip the long linear object and prevent unattended movement.

The movable jaw plates may each be equipped with a reach catch plate and a forward catch plate to allow for the long linear object to move within the movable jaw plates along its axis without worry of becoming disengaged. The support arms along with a horizontal plate may be firmly affixed to the back plate. The actuating arm may move along the first travel path with said motion being transferred to the support arms via the driver arms using four first pivot points. The support arms are pinned at a second pivot point, thus translating the linear motion of the actuating arm into radial motion that results in angular jaw travel path that will grab the long linear object between the movable jaw plates.

The angular protrusions may assist in grapping the long linear object or in grapping an odd shaped linear object. Attaching the post handling attachment may involve manipulation of a plurality of locking levers upon the locking lever area as well as engagement of a plurality of quick connect fittings on the high-pressure supply hose and the return hose. The tractor may then be manipulated over the long linear object and is centered. Once centered between the open movable jaw plates as well as the "U"-shaped restraint, the hydraulic controls of the "U"-shaped restraint may be engaged to close the movable jaw plates upon the long linear object. Using existing controls for the loader arms, the long linear object may be lifted whereupon it is transferred to another location by the tractor. Transportation may occur with the long linear object in a lowered horizontal position occurs with the long linear object in a vertical position as rotated along an angular lifting path. A user may manipulate the hydraulic controls of the tractor such that the loader arms position the back plate in a vertical position. The safety support and the "U"-shaped restraint may provide protection for the user should the long linear object unintentionally fall backwards as the movable jaw plates are released from pressure.

Once the long linear object is inserted into a bored hole, the movable jaw plates are completely opened and the tractor reversed. The long linear object and the insertion into the bored hole continues as many times as needed. The post handling attachment is an attachment to lift, handle and transport the long linear object. The post handling attachment may be attached to a tractor or attached to a skid steer machine. The post handling attachment may be made of various steel alloys.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
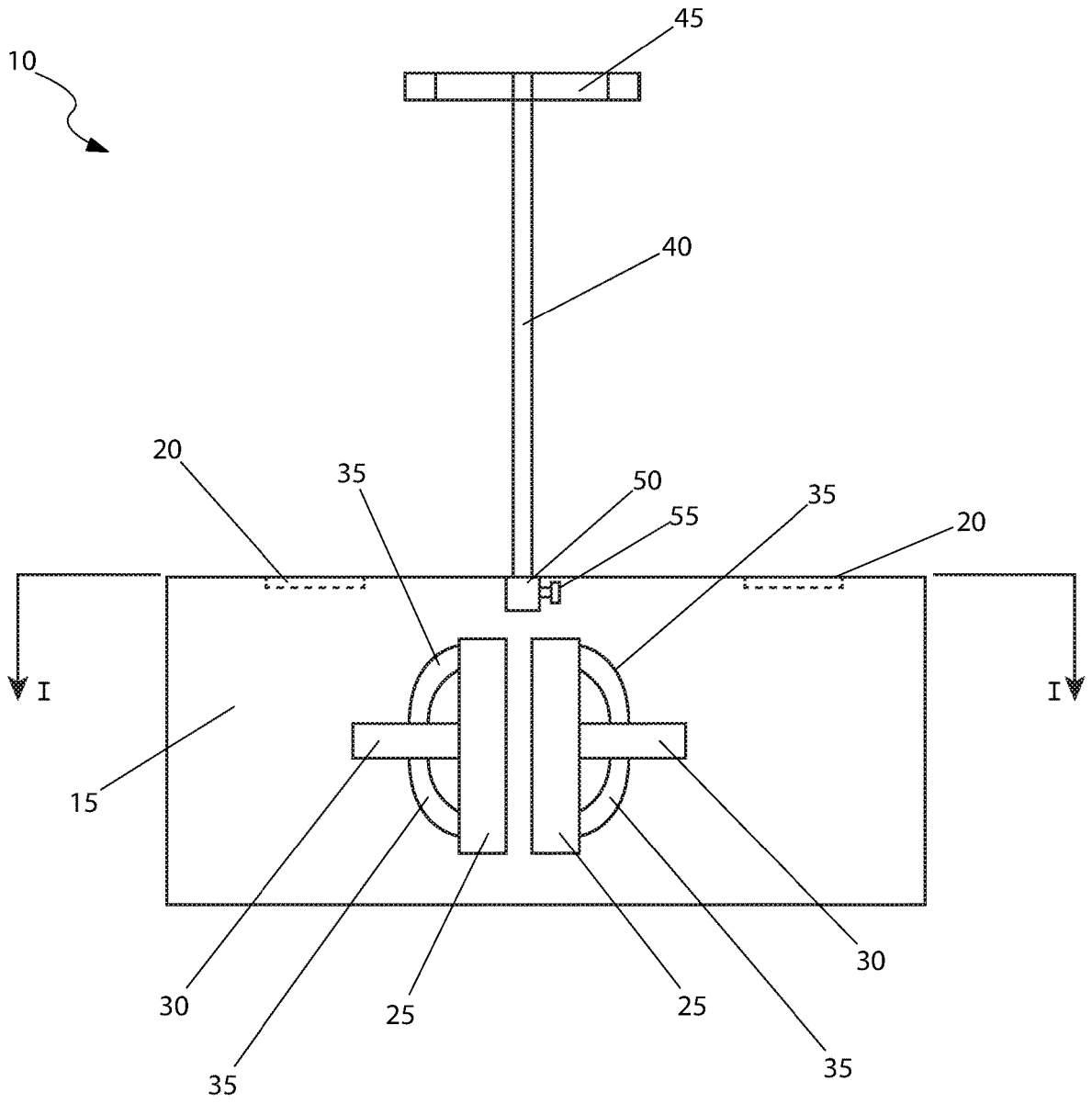
FIG. 1 is a front view of the post handling attachment 10, according to the preferred embodiment of the present invention.

10 post handling attachment
15 back plate
20 locking lever area
25 movable jaw plate
30 support arm
35 reinforcing support
40 safety support
45 "U"-shaped restraint
50 collar
55 anchor bolt
60 enclosure
65 hydraulic cylinder
70 actuating arm
75 first travel path "1"
80 driver arm
85 high pressure supply hose
90 return hose
95 quick connect fitting
100 first pivot point
105 second pivot point
110 angular jaw travel path
115 reach catch plate
120 forward catch plate
125 angular protrusion
130 piston
135 third pivot point
140 horizontal plate
145 tractor
150 loader arm
155 locking lever
160 linear object
165 angular lifting path "a"
170 bored hole
175 user

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the post handling attachment 10, according to the preferred embodiment of the present invention is disclosed. The post handling attachment 10 (herein also described as the "device") 10, is an attachment for tractors 145 and/or skid steer machines to lift, handle and transport long linear objects 160 such as posts, logs, pipes, or the like. It is more specifically designed to lift, transport, pull and set linear objects 160 such as a square post, sized from six to eight inches (6-8 in.) in width (diameter) and up to twenty feet (20 ft.) long. It is specifically adept at inserting the object 160 into pre-dug holes 170 such as those used for pole bam or elevated deck construction. The device 10 includes a back plate 15 that adapts to the standard skid steer attachment system found on skid steer machines and tractors 145. The attachment system uses two (2) locking lever areas 20 which are well-known in the art and not within the scope of the present invention. Two (2) movable jaw plates 25 are provided on the face of the device 10 and serve as the contact grabbing point for the object 160 being lifted. The movable jaw plates 25 are provided with support arms 30 to allow for grabbing movement of the movable jaw plates 25. Further description of the movable jaw plates 25 will be provided herein below.

Multiple reinforcing supports 35 are provided to reinforce the joint between the movable jaw plates 25 and the support arms 30. A safety support 40 is provided at the center top portion of the back plate 15 to restrain any lifted objects 160 from falling backwards. A "U"-shaped restraint 45 at the top of the safety support 40 prevents falling to the rear of the sides. The safety support 40 is attached to the back plate 15 using a collar 50 and anchor bolt 55 which allows for ready removal of the safety support 40 during transport of the device 10. The majority of the components comprising the device 10 would be made of various steel alloys using well-known cutting, forming, and attachment methods.

Figure 2:
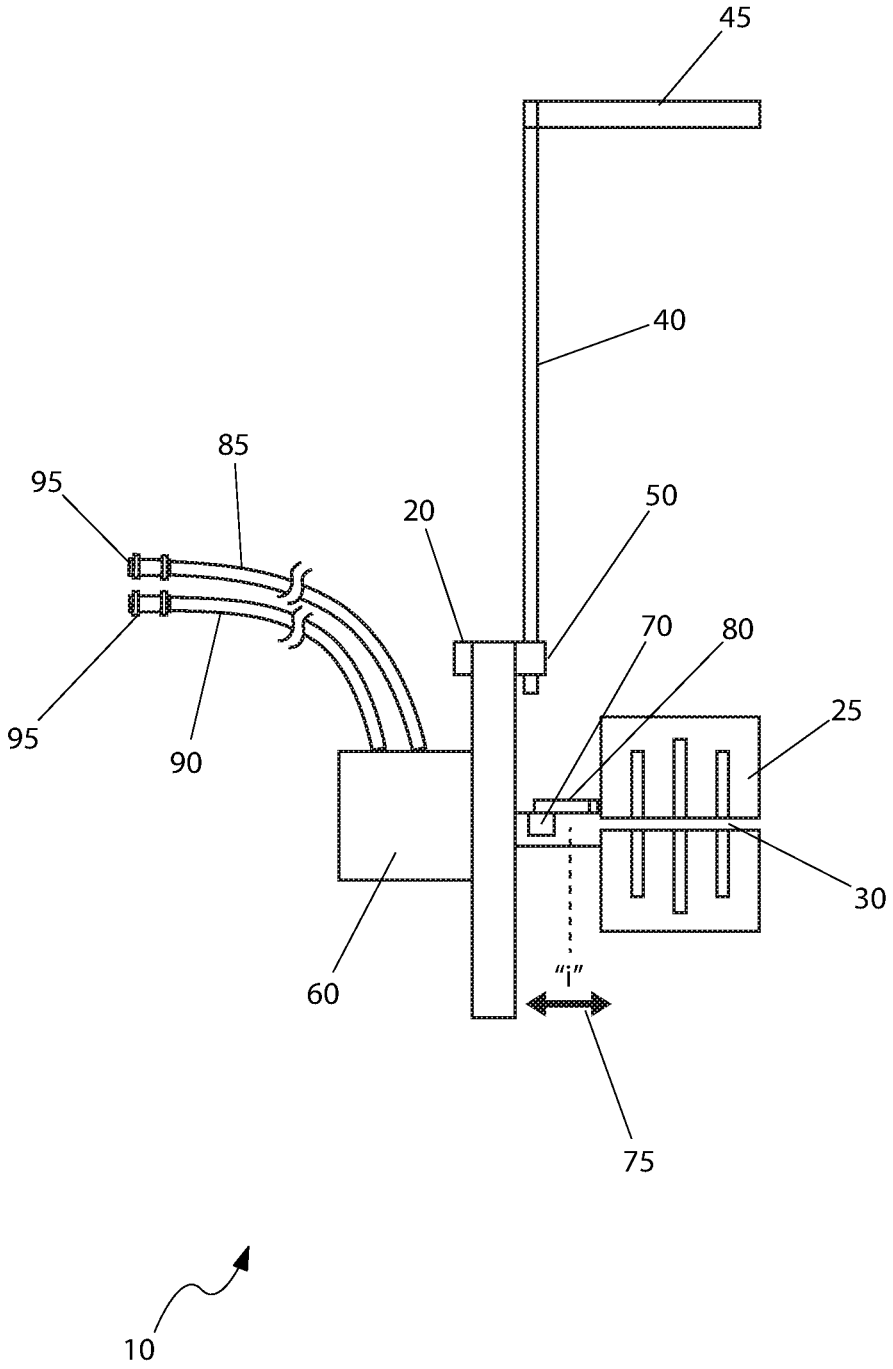
FIG. 2 is a side view of the post handling attachment 10, according to the preferred embodiment of the present invention.

Referring next to FIG. 2, a side view of the device 10, according to the preferred embodiment of the present invention is depicted. This view provides clarification on the movable jaw plates 25. An enclosure 60 houses a hydraulic cylinder 65 (not shown due to illustrative limitations), that drives an actuating arm 70 back and forth along a first travel path "1" 75. The actuating arm 70 is connected to the support arms 30 (of which only one (1) of two (2) total is shown due to illustrative limitations) via two (2) driver arms 80 (of which only one (1) is shown. This movement allows the movable jaw plates 25 to open and close, as will be described in greater detail herein below. The hydraulic cylinder 65 is connected to the hydraulic system of the host vehicle 145 via a high-pressure supply hose 85 and a return hose 90, each supplied with a quick connect fitting 95. The locking lever area 20 is visible on the rear of the back plate 15, while the safety support 40 along with the "U"-shaped restraint 45 is mechanically attached to the back plate 15 via the collar 50.

Figure 3:
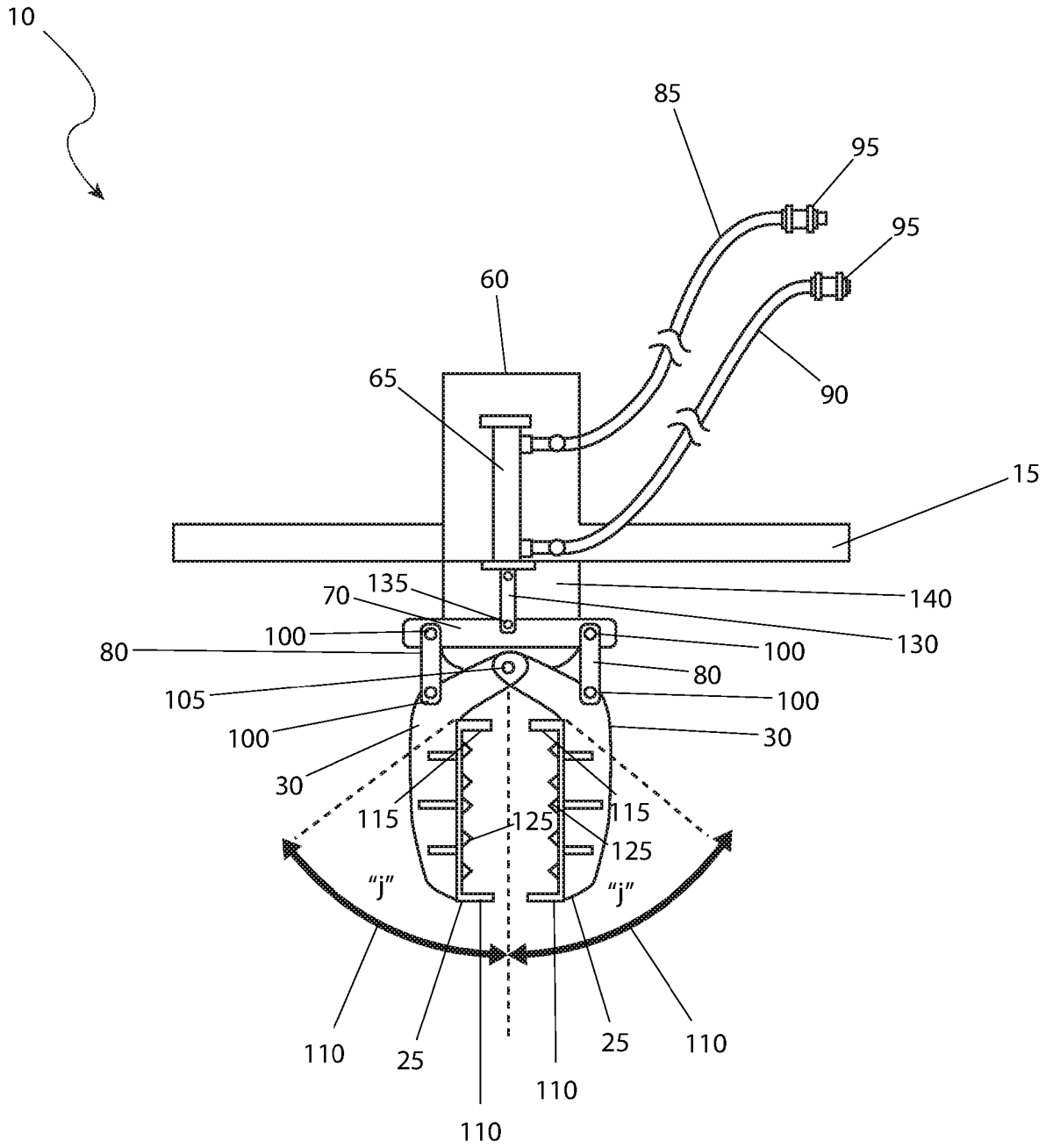
FIG. 3 is a sectional view of the post handling attachment 10, as seen along a line I-I, as shown in FIG. 1, according to the preferred embodiment of the present invention.

Referring now to FIG. 3, a sectional view of the device 10, as seen along a line I-I, as shown in FIG. 1, according to the preferred embodiment of the present invention is shown. This view provides clarification on the movement of the movable jaw plates 25. As the actuating arm 70 moves along the first travel path "1" 75 (as shown in FIG. 2), said motion is transferred to the support arms 30 via the driver arms 80 using four (4) first pivot points 100. The support arms 30 is pinned at a second pivot point 105, thus translating the linear motion of the actuating arm 70 into radial motion that results in angular jaw travel path 110 that will grab linear objects 160 between the movable jaw plates 25. The movable jaw plates 25 are each equipped with a reach catch plate 115 and a forward catch plate 120 to allow for the linear object 160 to move within the movable jaw plates 25 along its axis without worry of becoming disengaged. A set of angular protrusions 125 help to grip the linear object 160 and prevent unattended movement. The angular protrusions 125 would assist in grapping round or odd shaped linear objects 160 as well. The high-pressure supply hose 85 and the return hose 90 are connected to the hydraulic cylinder 65 inside of the enclosure 60 in an expected and customary manner. The piston 130 of the hydraulic cylinder 65 is connected to the actuating arm 70 via a third pivot point 135. The support arms 30 along with a horizontal plate 140 is firmly affixed to the back plate 15.

Figure 4:
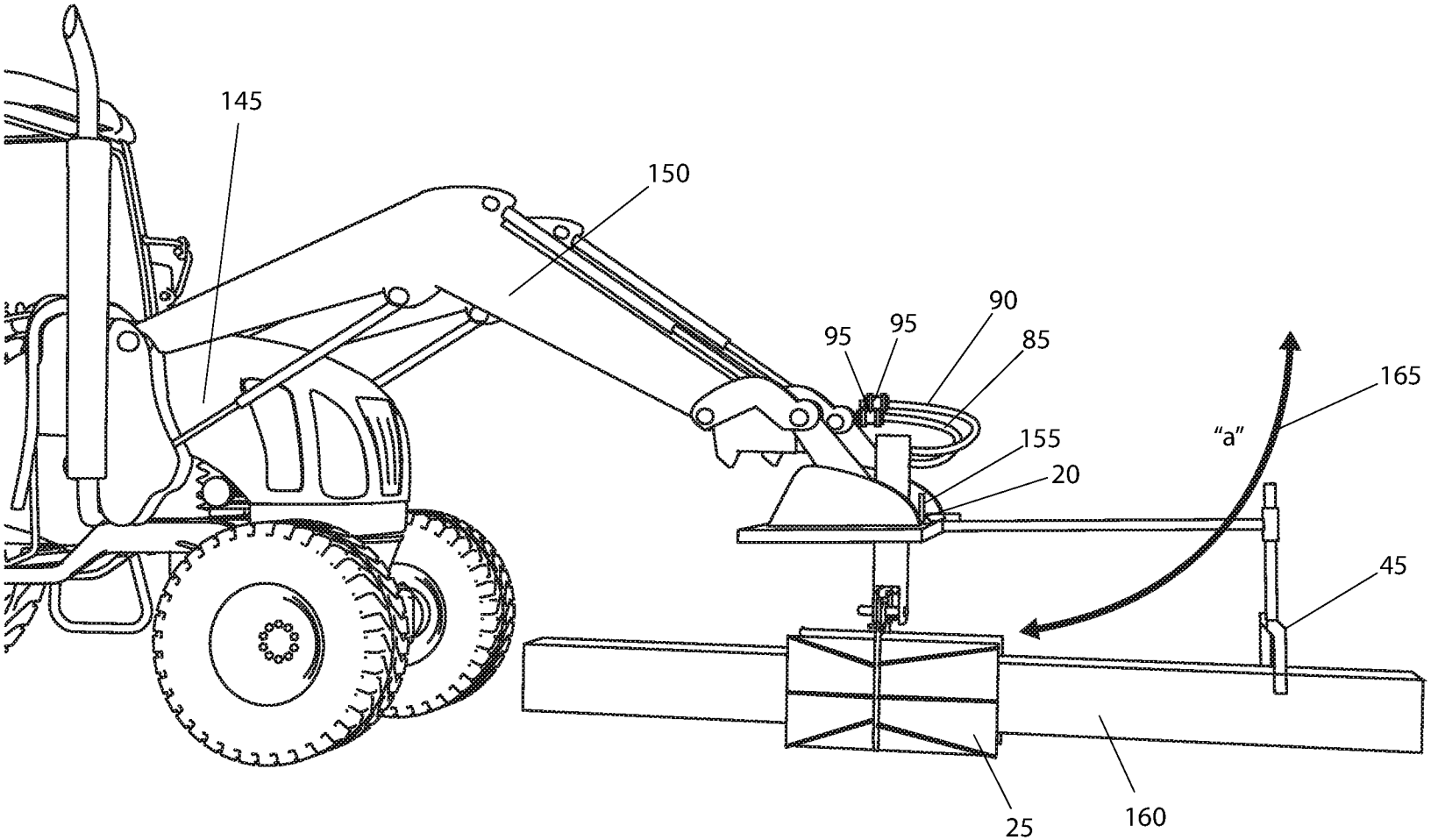
FIG. 4 is a pictorial view of the post handling attachment 10, shown in a utilized state, according to the preferred embodiment of the present invention; and, FIG. 5 is a pictorial view of the post handling attachment 10, shown in another utilized state, according to the preferred embodiment of the present invention.

Referring next to FIG. 4, a pictorial view of the device 10, shown in a utilized state, according to the preferred embodiment of the present invention is disclosed. The device 10 is attached to a tractor 145 previously equipped with loader arm(s) 150 (or "boom"). It is noted that while a tractor 145 is depicted in this and following illustrations, said device 10 would function equally as well with a skid steer machine. As such, the use of the device 10 with any particular type of equipment is not intended to be a limiting factor of the present inventions. The attachment process involves manipulation of locking levers 155 upon the locking lever area 20 as well as engagement of the quick connect fittings 95 on the high-pressure supply hose 85 and the return hose 90. The tractor 145 is then manipulated over a linear object 160 (herein depicted as a post). Once centered between the open movable jaw plates 25 as well as the "U"-shaped restraint 45, the hydraulic controls of the "U"-shaped restraint 45 are engaged to close the movable jaw plates 25 upon the linear object 160. Using existing controls for the loader arms 150, the linear object 160 is then lifted whereupon it may be transferred to another location by the tractor 145. The transportation may occur with the linear object 160 in a lowered horizontal position as shown or may occur with the linear object 160 in a vertical position as rotated along an angular lifting path "a" 165, as will be shown in greater detail herein below.

Figure 5:
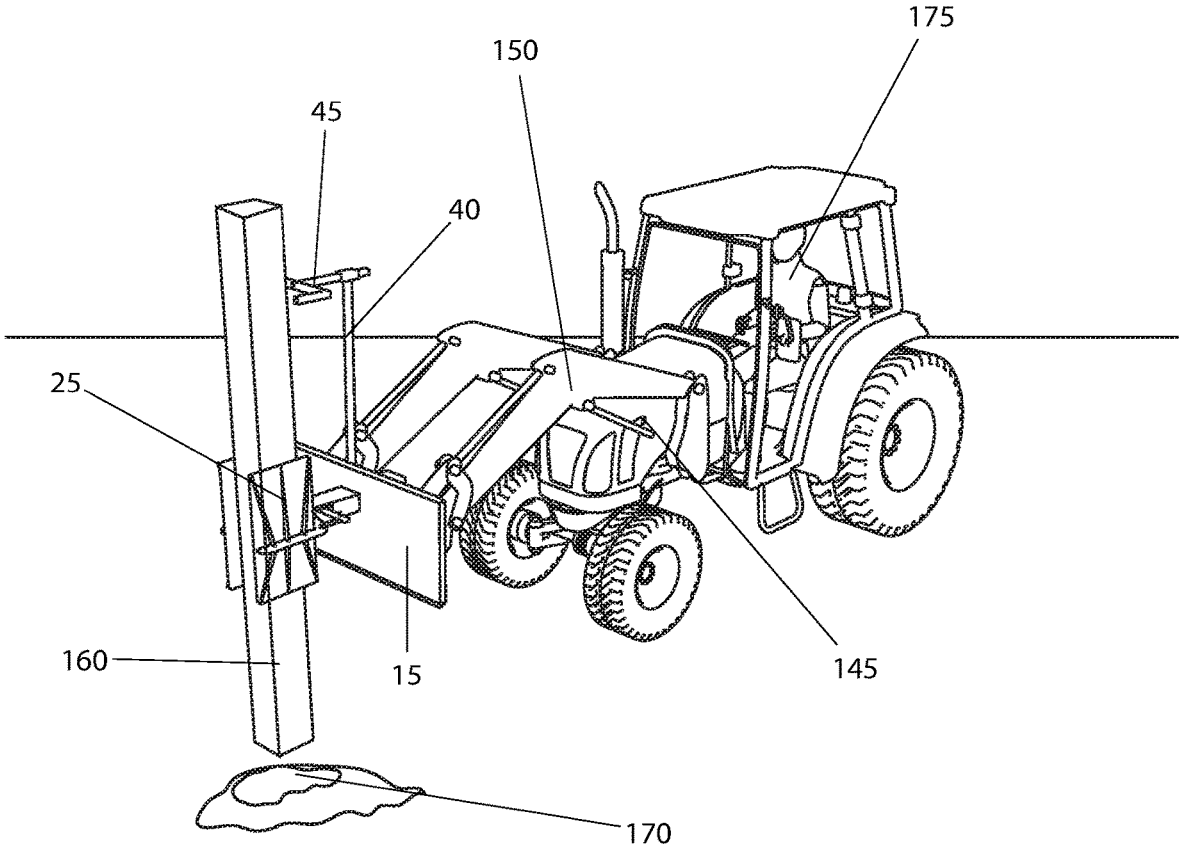

Referring to FIG. 5, a pictorial view of the device 10, shown in another utilized state, according to the preferred embodiment of the present invention is depicted. This view provides clarification of the linear object 160 in a vertical position, either for transport, or for insertion into a bored hole 170. The user 175 would manipulate the hydraulic controls of the tractor 145 such that the loader arms 150 position the back plate 15 in a vertical position. The safety support 40 and "U"-shaped restraint 45 provide protection for the user 175 should the linear object 160 unintentionally fall backwards as the movable jaw plates 25 are released from pressure. Once the linear object 160 is inserted into the bored hole 170, the movable jaw plates 25 may be completely opened and the tractor 145 reversed. The process of lifting the linear object 160 (as shown in FIG. 4) and the insertion into a bored hole 170 may continue as many times as needed.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 via conventional procurement channels such as farm machinery stores, rental stores, heavy equipment stores, mail order or internet supply houses or the like. Special attention would be paid to overall size of the device 10, compatibility with the intended tractor 145.

After procurement and prior to utilization, the device 10 would be prepared in the following manner: the locking lever area 20 of the back plate 15 would be engaged with the loader arms 150 of the tractor 145 and the locking levers 155 would be manipulated to a locked position following the same process as used with other attachable implements for a tractor 145. The high-pressure supply hose 85 and the return hose 90 would be attached via the quick connect fittings 95 to the hydraulic system of the tractor 145. At this point in time, the device 10 is ready for utilization.

During utilization of the device 10, the following procedure would be initiated: the tractor 145 is manipulated over a linear object 160 that is isolated from other linear object 160; once centered between the open movable jaw plates 25 as well as the "U"-shaped restraint 45, the hydraulic controls of the "U"-shaped restraint 45 are engaged to close the movable jaw plates 25 upon the linear object 160; using existing controls for the loader arms 150, the linear object 160 is then lifted whereupon it may be transferred to another location by the tractor 145 in either a horizontal or vertical position; upon arrival at a bored hole 170, the various existing controls of the tractor 145 are manipulated to place the linear object 160 over the bored hole 170 whereupon the hydraulic controls on the tractor 145 for the hydraulic cylinder 65 are released allowing the linear object 160 to fall into the bored hole 170. The process of lifting, transporting and insertion of additional linear object 160 may occur as needed.

When finished with use, the device 10 may be removed from the tractor 145 by releasing the high-pressure supply hose 85 and return hose 90 as well as disengaging the locking levers 155 from the locking lever area 20.

It is envisioned that use of the device 10 provides the following benefits: one-man transportation, lifting and erection of long, heavy, linear object 160, increased safety, manpower and time savings, and increased consistency.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A post handling tool comprising:

a back plate adapted to a standard skid steer attachment system found on a skid steer machine or a tractor;

a pair of horizontal movable jaw plates provided on a face of the post handling attachment, the pair of horizontal movable jaw plates serve as a contact grabbing point for a long linear object being lifted, the horizontal movable jaw plates are each provided with a support arm to allow for grabbing movement of the horizontal movable jaw plates;

a plurality of reinforcing supports provided to reinforce a joint between the horizontal movable jaw plates and the support arms;

a safety support provided at a center top portion of the back plate to restrain the lifted long linear object from falling backwards;

a U-shaped restraint disposed at a top of the safety support to prevent falling behind the sides of the post handling attachment, the safety support is attached to the back plate using a collar and an anchor bolt which allows for ready removal of the safety support during transport of the post handling attachment;

an enclosure housing a hydraulic cylinder that drives an actuating arm back and forth along a first travel path, the actuating arm is connected to the support arms via a pair of driver arms to allow the horizontal movable jaw plates to open and close, the hydraulic cylinder is connected to a hydraulic system of a host vehicle via a high-pressure supply hose and a return hose supplied with a quick connect fitting, the safety support along with the "U"-shaped restraint is mechanically attached to the back plate via the collar, a piston of the hydraulic cylinder is connected to the actuating arm via a third pivot point; and a plurality of angular protrusions helping to grip the long linear object and prevent unattended movement;

wherein the angular protrusions would assist in grasping the long linear objects;

wherein the horizontal movable jaw plates are each equipped with a reach catch plate and a forward catch plate to allow for the long linear object to move within the horizontal movable jaw plates without worry of becoming disengaged;

wherein the support arms along with a horizontal plate is firmly affixed to the back plate;

wherein the support arms are pinned at a second pivot point, thus translating the linear motion of the actuating arm into radial motion that results in angular jaw travel path that will grab the long linear object between the horizontal movable jaw plates; and wherein the post handling attachment is attached to the skid steer machine.

2. The post handling tool according to claim 1, wherein the actuating arm moves along the first travel path, said motion is transferred to the support arms via the driver arms using four first pivot points.

3. The post handling tool according to claim 1, wherein the angular protrusions would assist in grasping a linear object.

4. The post handling tool according to claim 1, wherein attaching the post handling attachment involves manipulation of a plurality of locking levers upon a locking lever area as well as engagement of a plurality of quick connect fittings on the high-pressure supply hose and the return hose.

5. The post handling tool according to claim 4, wherein the tractor is then manipulated over the long linear object and is centered.

6. The post handling tool according to claim 5, wherein once centered between the open horizontal movable jaw plates as well as the "U"-shaped restraint, a plurality of hydraulic controls of the "U"-shaped restraint are engaged to close the horizontal movable jaw plates upon the long linear object.

7. The post handling tool according to claim 1, wherein using existing controls for a plurality of loader arms, the long linear object is then lifted whereupon the long linear object is transferred to another location by the tractor.

8. The post handling tool according to claim 1, wherein a user manipulates a plurality of hydraulic controls of the tractor such that a plurality of loader arms position the back plate in a vertical position.

9. The post handling tool according to claim 8, wherein the safety support and the "U"-shaped restraint provide protection for the user should the long linear object unintentionally fall backwards as the horizontal movable jaw plates are released from pressure.

10. The post handling tool according to claim 1, wherein once the long linear object is inserted into a bored hole, the horizontal movable jaw plates are completely opened and the tractor reversed.

11. The post handling tool according to claim 10, wherein the long linear object and the insertion into the bored hole continues as many times as needed.

12. The post handling tool according to claim 1, wherein the post handling attachment is an attachment to lift, handle and transport the long linear object.

13. The post handling tool according to claim 1, wherein the post handling attachment is made of various steel alloys.

* * * * *